US010683699B2

(12) United States Patent
Wang

(10) Patent No.: US 10,683,699 B2
(45) Date of Patent: Jun. 16, 2020

(54) SAFETY GATE

(71) Applicant: DEMBY DEVELOPMENT CO., LTD., New Taipei (TW)

(72) Inventor: Tsung Hsiang Wang, New Taipei (TW)

(73) Assignee: DEMBY DEVELOPMENT CO., LTD., New Taipei (TW)

( * ) Notice: Subject to any disclaimer, the term of this patent is extended or adjusted under 35 U.S.C. 154(b) by 219 days.

(21) Appl. No.: 15/928,796

(22) Filed: Mar. 22, 2018

(65) Prior Publication Data

US 2018/0274288 A1 Sep. 27, 2018

(30) Foreign Application Priority Data

Mar. 27, 2017 (CN) ..... 2017 2 0305174

(51) Int. Cl.
*E06B 9/04* (2006.01)
*E06B 9/02* (2006.01)
*E06B 9/00* (2006.01)

(52) U.S. Cl.
CPC ..... *E06B 9/04* (2013.01); *E06B 9/02* (2013.01); *E06B 2009/002* (2013.01)

(58) Field of Classification Search
CPC ..... E06B 9/04; E06B 2009/002
See application file for complete search history.

(56) References Cited

U.S. PATENT DOCUMENTS 4,431,331 A * 2/1984 Brody ..... F16B 7/0446 403/189
5,531,258 A * 7/1996 Poulson ..... E06B 9/02 160/371
5,575,113 A * 11/1996 Huang ..... E06B 9/02 160/372
5,638,885 A * 6/1997 Freese ..... E06B 9/02 160/225
5,657,809 A * 8/1997 Longoria ..... E06B 9/04 160/160
5,797,218 A * 8/1998 Holland ..... E06B 9/04 49/55
6,536,163 B1 * 3/2003 Monahan ..... E05B 65/0014 292/336.3
7,334,624 B2 * 2/2008 Waldman ..... E05B 17/2053 160/144
7,658,220 B2 * 2/2010 Yates ..... E06B 9/04 160/377
8,418,407 B2 * 4/2013 Wang ..... E06B 9/0623 49/463
8,713,851 B2 * 5/2014 Flannery ..... E06B 9/04 49/55
9,091,113 B2 * 7/2015 Pilgrim ..... E06B 9/06
(Continued)

*Primary Examiner* — Catherine A Kelly
(74) *Attorney, Agent, or Firm* — Rabin & Berdo, P.C.

(57) ABSTRACT

A safety gate has a main body, a connecting tube, and a first elastic piece. The main body has two first rods and two second rods, and the two second rods are perpendicular to the two first rods. The connecting tube is mounted on the first rods. The first elastic piece has two first functional sides. At least one of the first functional sides is formed on a top surface of the first elastic piece, the two first functional sides abut an inner surface of the end portion, and a first protruding portion is mounted through a connecting hole of the second rod and a joining hole of the connecting tube.

9 Claims, 14 Drawing Sheets

(56) References Cited

U.S. PATENT DOCUMENTS

| | | | | |
|---|---|---|---|---|
| 9,963,932 | B2 * | 5/2018 | Wang | E06B 9/02 |
| 10,024,080 | B2 * | 7/2018 | Marsden | E05B 65/0007 |
| 10,081,980 | B2 * | 9/2018 | Birkert | E06B 9/04 |
| 2009/0158665 | A1 * | 6/2009 | Wu | E06B 9/02 49/55 |
| 2012/0174484 | A1 * | 7/2012 | Toro | E06B 9/04 49/50 |
| 2012/0324792 | A1 * | 12/2012 | Bertsch | E06B 9/04 49/37 |
| 2013/0212950 | A1 * | 8/2013 | Bertsch | E06B 9/04 49/464 |
| 2015/0101250 | A1 * | 4/2015 | Marsden | E06B 9/0623 49/55 |
| 2017/0350165 | A1 * | 12/2017 | Schort | E05C 3/16 |

* cited by examiner

SAFETY GATE

BACKGROUND OF THE INVENTION

1. Field of the Invention

The invention relates to a safety gate, and more particularly to a safety gate which is easy to be disassembled.

2. Description of Related Art

A safety gate is installed around a place where babies or children may be situated, the safety gate may prevent children from entering the kitchen, the bathroom, the balcony, or any area with potential danger. The safety gate can also be mounted around a baby bed, to protect the baby from falling. The safety gate can also block pets in a space, to prevent the pets running around.

The safety gate is usually square in shape and has two horizontal bars and two vertical rods. The two vertical rods of the safety gate are connected to two columns of the installation area (kitchen, bathroom, balcony or children's bed) so that the safety gate has a door-like function for protection. In order to facilitate the transportation of the safety gate, the horizontal bars are usually detachably connected with the vertical rods. Before use, the safety gate needs to be assembled. After use, the safety gate also needs to be disassembled. However, the conventional safety gate is hard to be disassembled.

SUMMARY OF THE INVENTION

The main objective of the present invention is to provide a safety gate that is easy to be disassembled.

The safety gate has a main body, a connecting tube, and a first elastic piece. The main body has two first rods and two second rods, and the two second rods are perpendicular to the two first rods. The connecting tube is mounted on the first rod. The first elastic piece has two first functional sides. At least one of the first functional sides is formed on a top surface of the first elastic piece, the two first functional sides respectively abut an inner surface of the end portion, and a first protruding portion is mounted through a connecting hole of the second rod and a joining hole of the connecting tube.

Other objects, advantages, and novel features of the invention will become more apparent from the following detailed description when taken in conjunction with the accompanying drawings.

DETAILED DESCRIPTION OF PREFERRED EMBODIMENT

Figure 1:
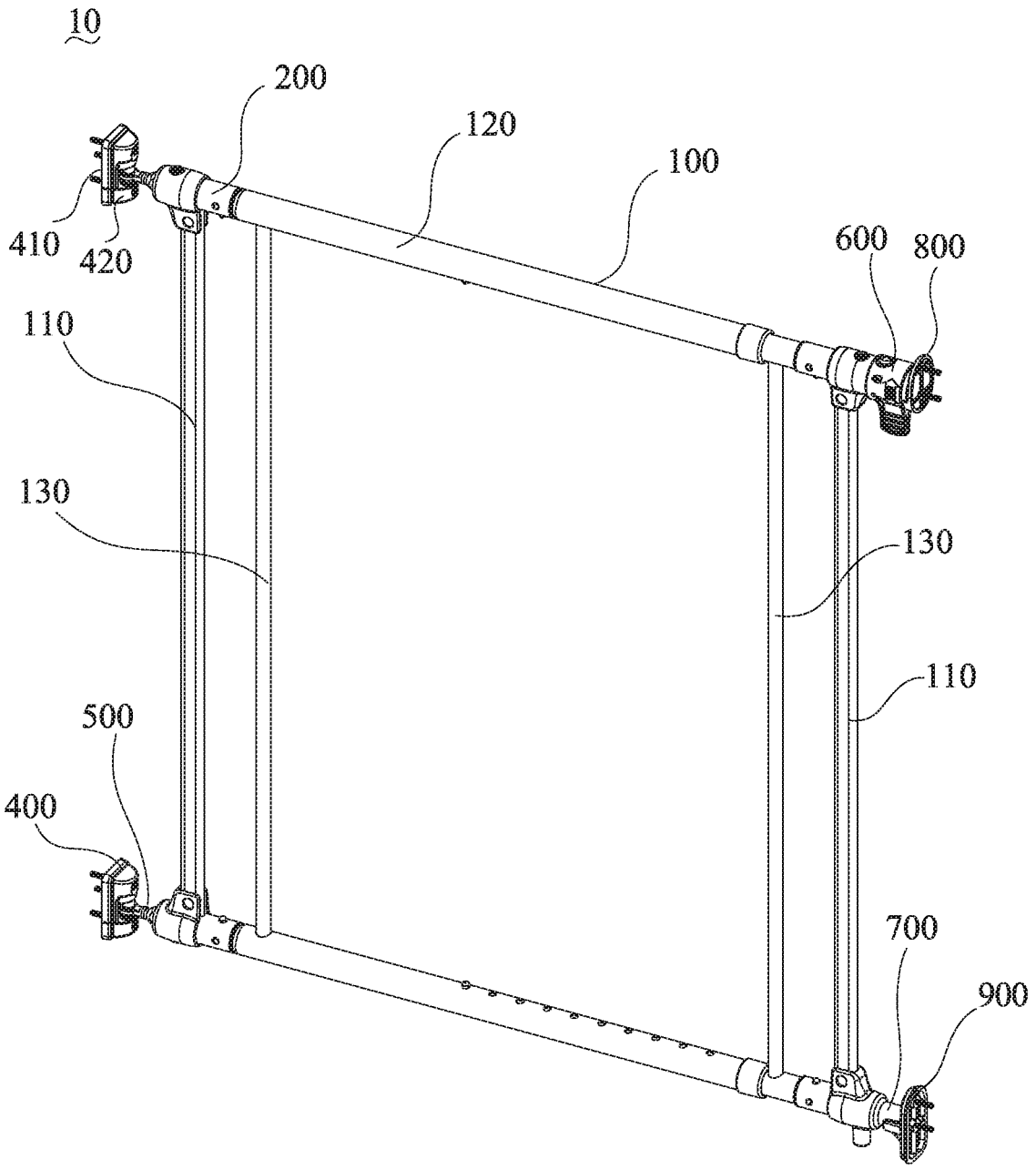
FIG. 1 is a perspective view of a safety gate in accordance with the present invention.

With reference to FIGS. 1 to 3 and 9, a safety gate 10 in accordance with the present invention comprises a main body 100, a connector element 200, a cloth cover 300, a fixing element 400, an adjustment element 500, a locking element 600, a mounting shaft 700, a first overlap mechanism 800, and a second overlap mechanism 900. The safety gate 10 may be installed at two columns of a door frame.

Figure 2:
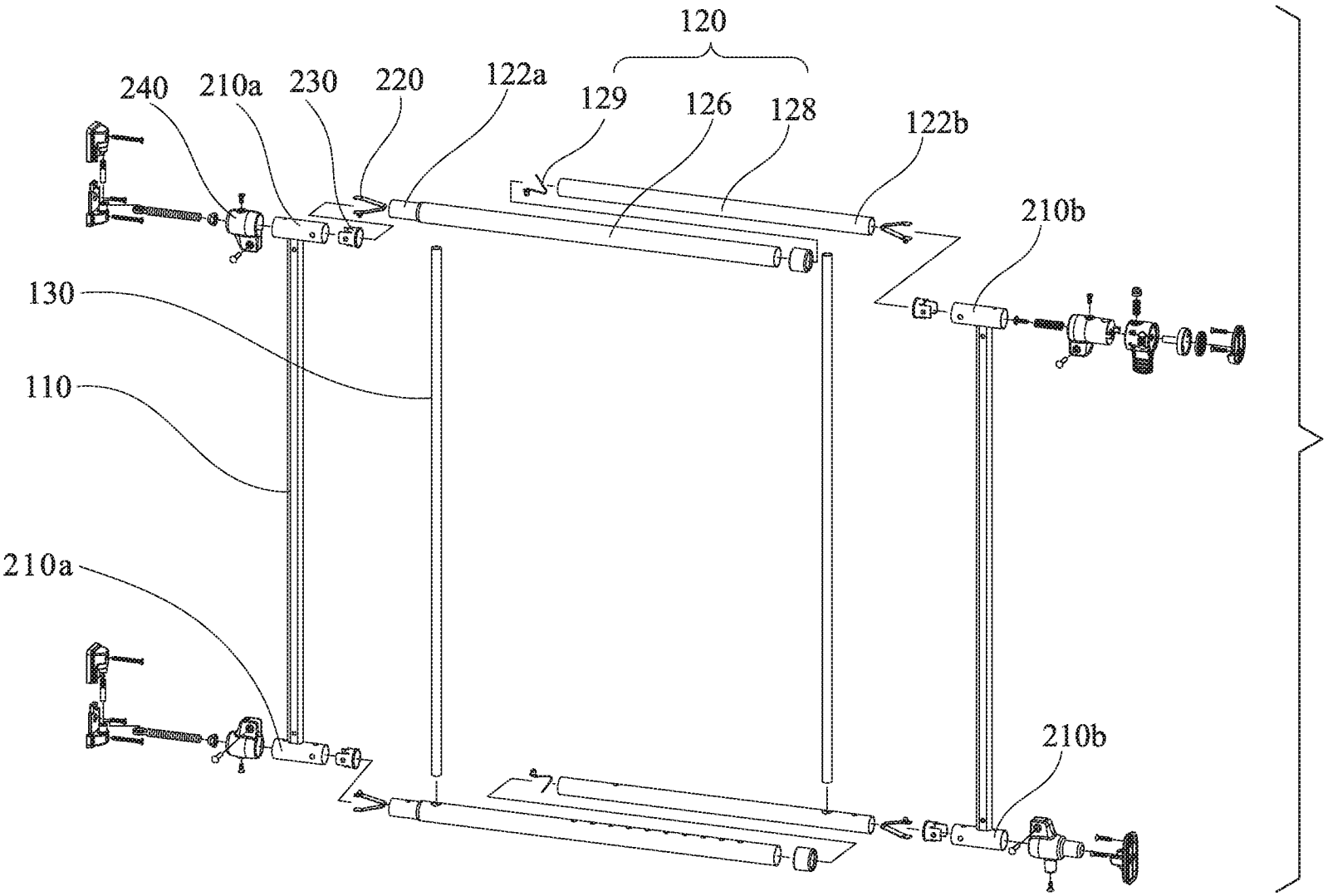
FIG. 2 is an exploded perspective view of the safety gate in FIG. 1.
Figure 3:
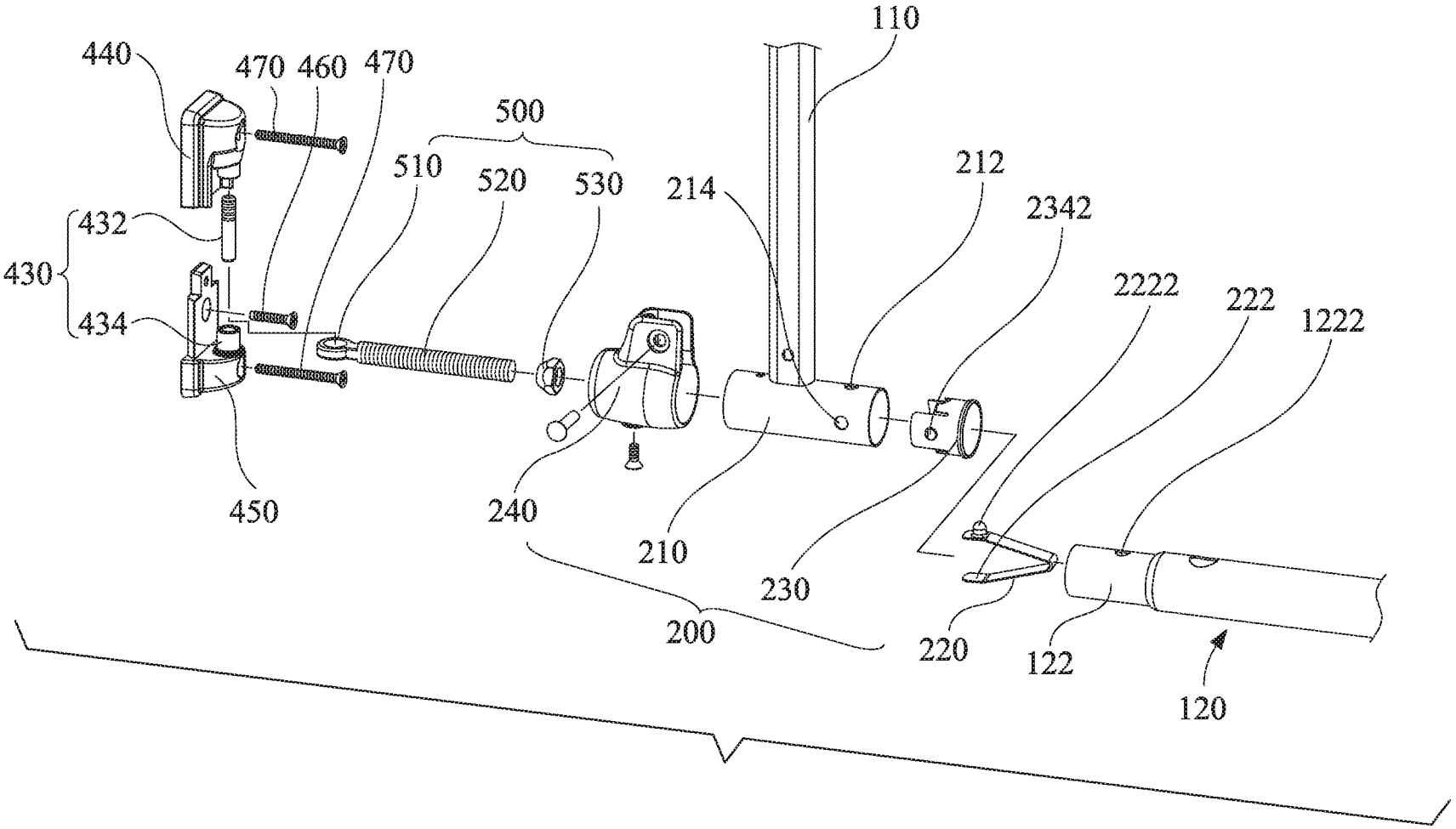
FIG. 3 is an enlarged exploded perspective view of the safety gate in FIG. 1.
Figure 4:
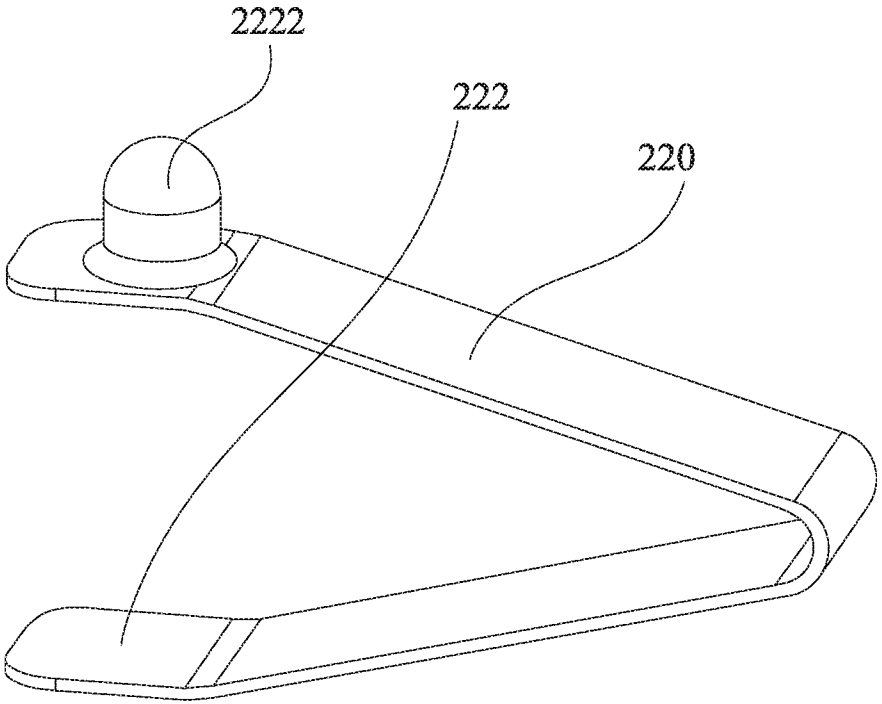
FIG. 4 is a perspective view of a first elastic piece of the safety gate in FIG. 1.

With reference to FIGS. 2, 3, and 4, the main body 100 has two first rods 110 and two second rods 120. The two first rods 110 are perpendicular to the two second rods 120. Each first rod 110 has a first end and a second end. Preferably, the two first rods 110 are vertical rods, and the two second rods 120 are horizontal rods.

The connector element 200 has a connecting tube 210 and a first elastic piece 220. The connecting tube 210 is mounted on the first end of the first rod 110, and the connecting tube 210 is perpendicular to the first rod 110. The connecting tube 210 has a joining hole 212. The joining hole 212 is formed through the connecting tube 210.

Each second rod 120 has an end portion 122. The end portion 122 has a connecting hole 1222. The end portion 122 is mounted in the connecting tube 210. The connecting hole 1222 is aligned with the joining hole 212.

The first elastic piece 220 has two first functional sides 222. At least one of the first functional sides 222 has a first protruding portion 2222, and the first protruding portion 2222 is formed on a top surface of the first elastic piece 220. The first elastic piece 220 is mounted in the end portion 122. The two first functional sides 222 abut an inner surface of the end portion 122. The first protruding portion 2222 is mounted through the connecting hole 1222 and the joining hole 212. Preferably, the first elastic piece 220 is V-shaped. Alternatively, the first elastic piece 220 may be U-shaped or W-shaped.

In the safety gate 10, when the first rod 110 is assembled with the second rod 120, the first protruding portion 2222 is aligned with the connecting hole 1222. Then, the end portion 122 is pushed into the connecting tube 210, and this makes the first rod 110 connected with the second rod 120. For disassembling the first rod 110 and the second rod 120, the first protruding portion 2222 is pressed into the connecting tube 210. In the mean time, the second rod 120 is pulled, and this makes the first rod 110 disassembled from the second rod 120. The first rod 110 and the second rod 220 are connected together via the first elastic piece 220. Therefore, in the disassembling process, users do not need any auxiliary tools and can disassemble the safety gate easily.

Furthermore, in the embodiment, in order to increase the connection strength between the first rod 110 and the second rod 120, the connector element 200 further has an inner tube 230, and the inner tube 230 is located between the end portion 122 and the connecting tube 210. The inner tube 230 is in an interference fit with the end portion 122 and the connecting tube 210 respectively.

Figure 5:
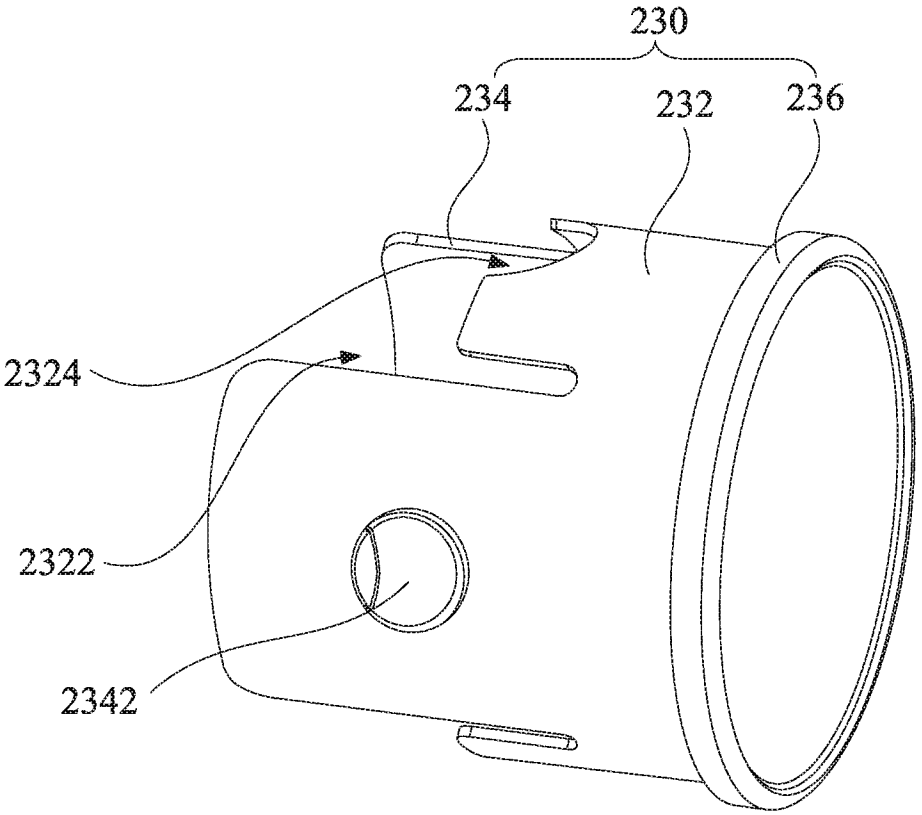
FIG. 5 is a perspective view of an inner tube of the safety gate in FIG. 1.

With reference to FIGS. 3 and 5, the inner tube 230 has two escaping walls 232, two connecting walls 234, and a ring body 236. The two escaping walls 232 abut the two first functional sides 222. The two connecting walls 234 are respectively formed at two sides of one of the escaping walls 232. An escaping recess 2322 is formed in one of the two escaping walls and is adjacent to the first rod 110. The first protruding portion 2222 is mounted through the escaping recess 2322. A receiving recess 2324 is formed in a bottom of the escaping recess 2322, and a shape of the receiving recess 2324 corresponds to a shape of the first protruding portion 2222. The first protruding portion 2222 is mounted in the receiving recess 2324. The ring body 236 is connected with the two escaping walls 232 and the two connecting walls 234.

Furthermore, to improve the connection strength between the first rod 110 and the second rod 120, each connecting wall 234 has a mounting stud 2342. The mounting stud 2342 protrudes from an outer surface of the connecting wall 234. The connecting tube 210 has a mounting hole 214 formed through the connecting tube 210. The mounting stud 2342 is mounted through the mounting hole 214.

Furthermore, with reference to FIG. 1, the safety gate 10 has two third rods 130. The third rods 130 are parallel to the first rods 110, and an end of each third rod 130 is inserted into one of the second rods 120. Each third rod 130 may increase the structure strengthens of the main body 100.

Figure 6:
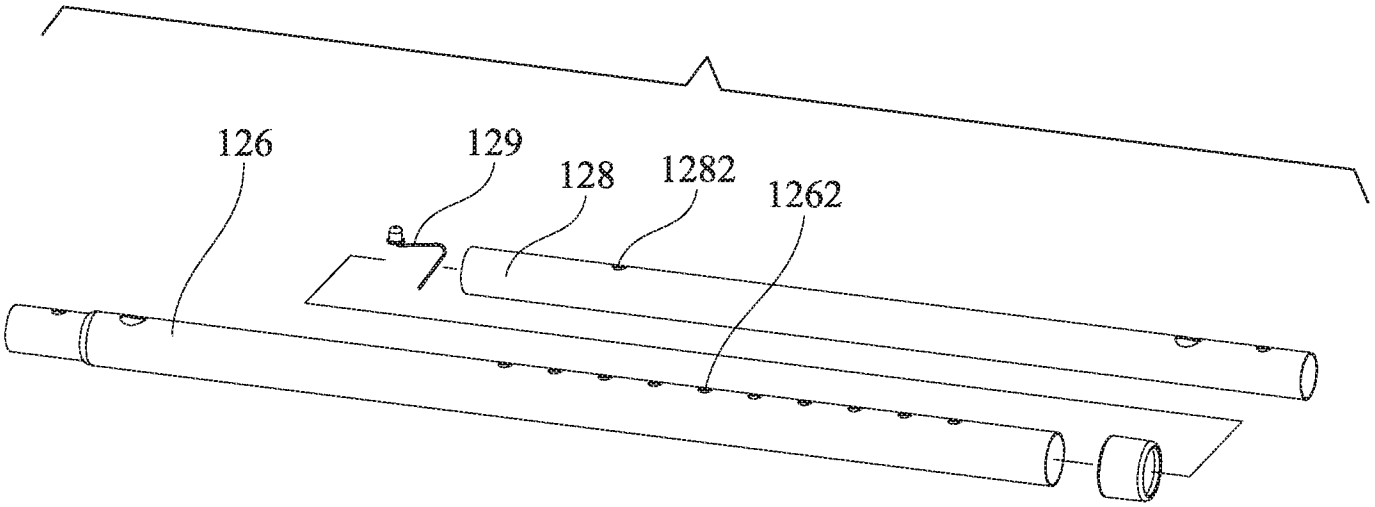
FIG. 6 is an exploded perspective view of a second rod of the safety gate in FIG. 1.
Figure 7:
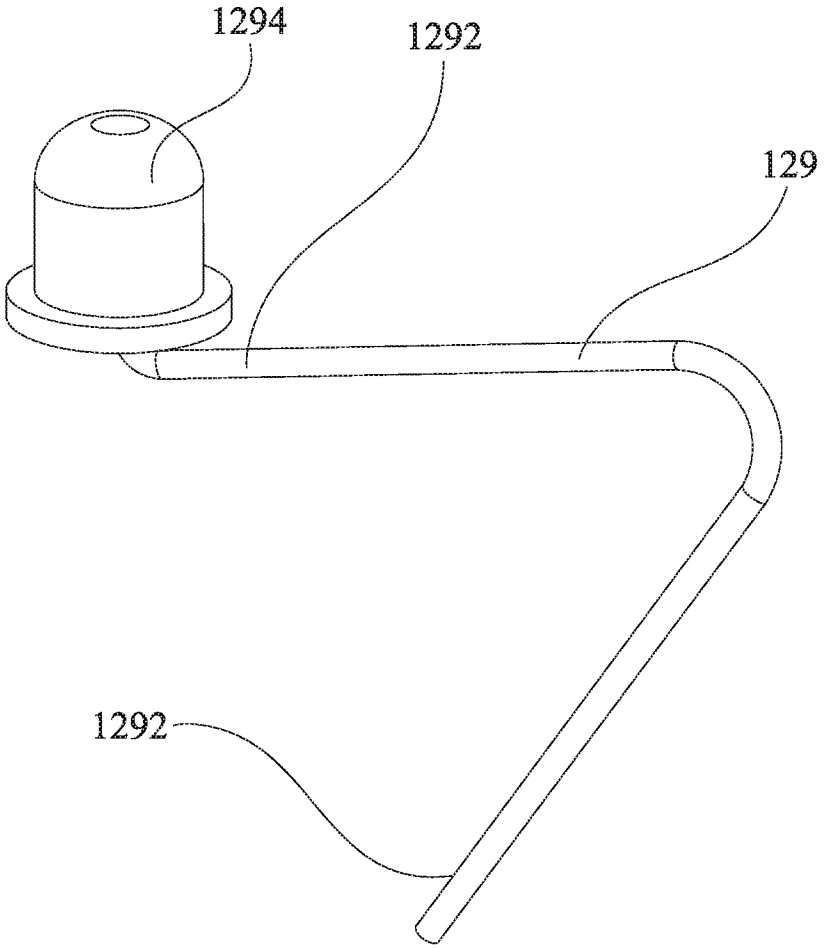
FIG. 7 is a perspective view of a second elastic piece of the safety gate in FIG. 1.

With reference to FIGS. 2, 6, and 7, the second rods 120 may be telescopic, and each second rod 120 has an outer tube 126, an inner tube 128, and a second elastic piece 129. The outer tube 126 has multiple outer through holes 1262 formed radially in the outer tube 126 and aligned in a row. The inner tube 128 is mounted in the outer tube 126 and has multiple inner through holes 1282. The multiple inner through holes 1282 are formed radially in the inner tube 128. The second elastic piece 129 is mounted in the inner tube 128 and has two second functional sides 1292 and a second protruding portion 1294. The two second functional sides 1292 abut an inner surface of the inner tube 128. The second protruding portion 1294 protrudes from one of the second functional sides 1292. One of the two second functional sides 1292 is mounted through one of the outer through holes 1262 and one of the inner through holes 1282. Each second rod 120 has two end portions 122, and at least one of the two end portions 122 is arranged at the inner tube 128.

With reference to FIG. 2, the end portion 122 has a first end section 122*a* and a second end section 122*b*. The first end section 122*a* is formed at one end of the second rod 120. The second end section 122*b* is formed at the other end of the second rod 120. The second end section 122*b* is part of the inner tube 128.

Furthermore, in the embodiment, the number of the third rods 130 is two, and one of the third rods 130 is inserted into the outer tube 126. The other third rod 130 is inserted into the inner tube 128.

Furthermore, in the embodiment, the first rod 110 is a square tube, and the connecting tube 210 and the two end portions 122 are circular tubes.

Figure 8:
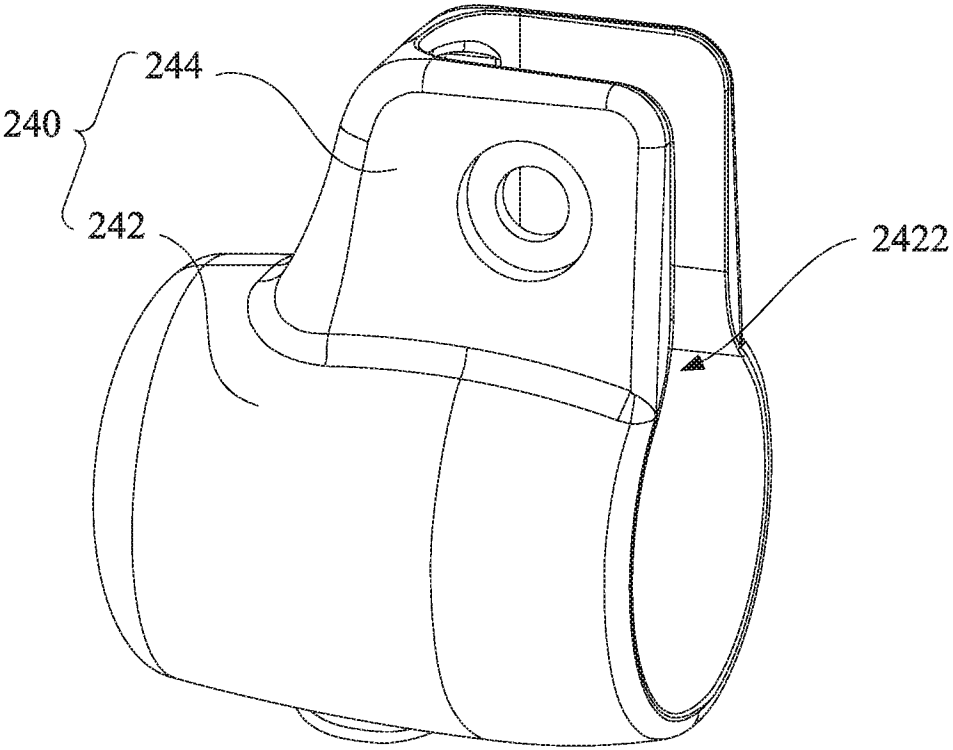
FIG. 8 is a perspective view of a socket of the safety gate in FIG. 1.

With reference to FIGS. 3 and 8, in the embodiment, the connector element 200 further has a socket 240. The socket 240 has a cylindrical body 242 and two clamping boards 244. The cylindrical body 242 has a first end, a second end, and a mounting groove 2422, and the mounting groove 2422 is formed in the first end of the body 242. The two clamping boards 244 are mounted on the first end of the cylindrical body 242. The connecting tube 210 is inserted into the cylindrical body 242, and the first rod 110 is mounted between the two clamping boards 244.

Figure 9:
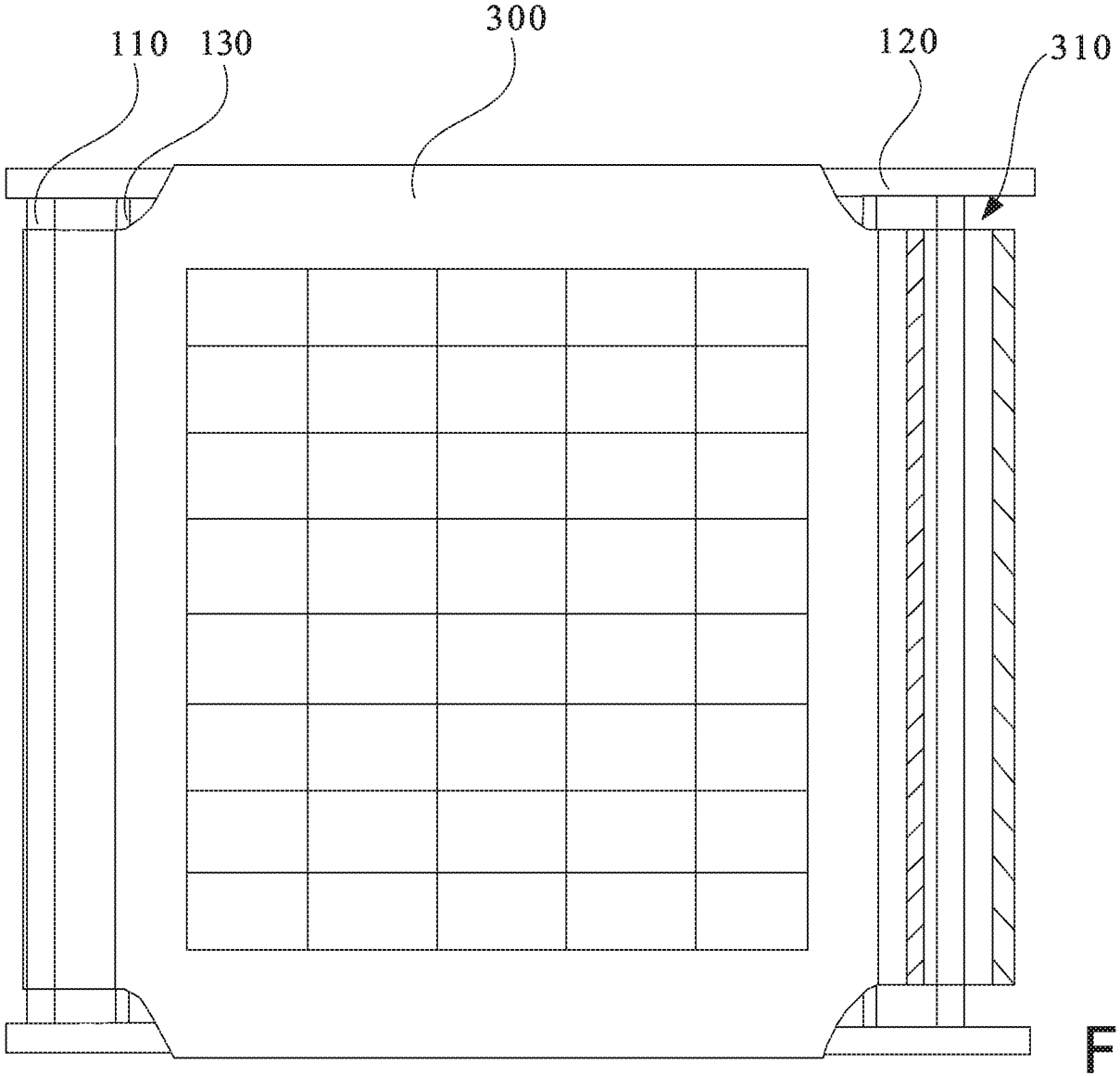
FIG. 9 is a front view of a cloth cover mounted on the safety gate in FIG. 1.

With reference to FIGS. 1 and 9, the cloth cover 300 has four corners and four notches 310. The four notches 310 are respectively formed at the four corners of the cloth cover 300. The cloth cover 300 has a first insertion hole, a second insertion hole, and a third insertion hole. The first rod 110 is mounted through the first insertion hole, and two ends of the first rod 110 extend from two of the notches 310, respectively. The second rod 120 is mounted through the second insertion hole, and two ends of the second rod 120 extend from two of the notches 310. The third rod 130 is mounted through the third insertion hole, and two ends of the third rod 130 extend from two of the notches 310.

With reference to FIG. 2, the two connecting tubes 210 include a first connecting tube 210*a* and a second connecting tube 210*b*. The first connecting tube 210*a* is connected with the first end section 122*a*, and the second connecting tube 210*b* is connected with the second end section 122*b*. When the safety gate 10 is installed between two columns, the first connecting tube 210*a* is connected with one of the two columns. The second connecting tube 210*b* is connected with the other column.

With reference to FIGS. 1 and 3, the fixing element 400 has a first surface 410 and a second surface 420. The first surface 410 is fixed on one of the two columns. The second surface 420 has a rotating shaft 430, and the rotating shaft 430 is parallel to the first rods 110.

The adjustment element 500 has a ring portion 510, a screw rod 520, and an adjustment nut 530. The ring portion 510 is mounted around the rotating shaft 430. The screw rod 520 is connected with the ring portion 510. The adjustment nut 530 is mounted around the screw rod 520. One end of the screw rod 520 away from the ring portion 510 is mounted in the first connecting tube 210*a*. The adjusting nut 530 is disposed between the ring portion 510 and the cylindrical body 242 for adjusting a distance between the ring portion 510 and the cylindrical body 242.

Furthermore, the fixing element 400 has a first rotating portion 440 and a second rotating portion 450. The first rotating portion 440 and the second rotating portion 450 are detachable from each other. The rotating shaft 430 has a first portion 432 and a second portion 434. The first portion 432 is connected with the first rotating portion 440, and the second portion 434 is connected with the second rotating portion 450. The first portion 432 and the second portion 434 are combined to form the rotating shaft 430. Since the first rotating portion 440 and the second rotating portion 450 are detachable from each other, the ring portion 510 is easily to be installed on the rotating shaft 430.

Figure 10:
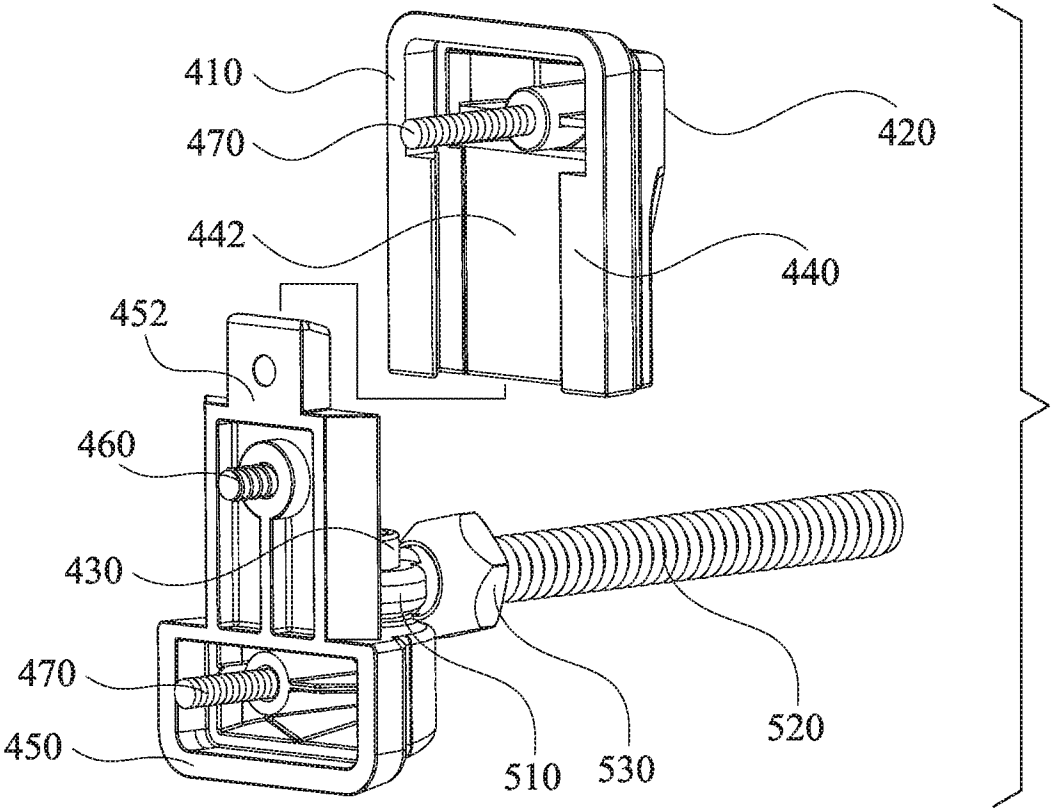
FIG. 10 is an exploded perspective view of a fixing element and an adjustment element of the safety gate in FIG. 1.

Specifically, with reference to FIGS. 3 and 10, the fixing element 400 further has a first fastener 460 and a second fastener 470. The first rotating portion 440 has an inserting groove 442 formed in the first surface 410. The second rotating portion 450 has a tab 452, and a shape of the tab 452 corresponds to a shape of the inserting groove 442. The tab 452 is mounted in the inserting groove 442. The first fastener 460 is mounted through the tab 452. One end of the first fastener 460 is disposed below the tab 452, and the other end of the first fastener 460 is fixed on the column. The second fastener 470 is mounted through the first rotating portion 440 and the second rotating portion 450. The second fastener 470 is disposed below the first fastener 460. Preferably, the first fastener 460 and the second fastener 470 are blots.

To install the fixing element 400, the first fastener 460 is used to fix the second rotating portion 450 to the column, and the first rotating portion 440 is positioned on the second rotating portion 450 through the inserting groove 442 and the tab 452. Finally, the first rotating portion 440 and the second rotating portion 450 are firmly fixed to the columns by the second fastener 470. The length of the rotating shaft 430 is greater than the thickness of the ring portion 510 in the extending direction of the rotating shaft 430. The ring portion 510 is movable in the axial direction of the rotating shaft 430.

Figure 11:
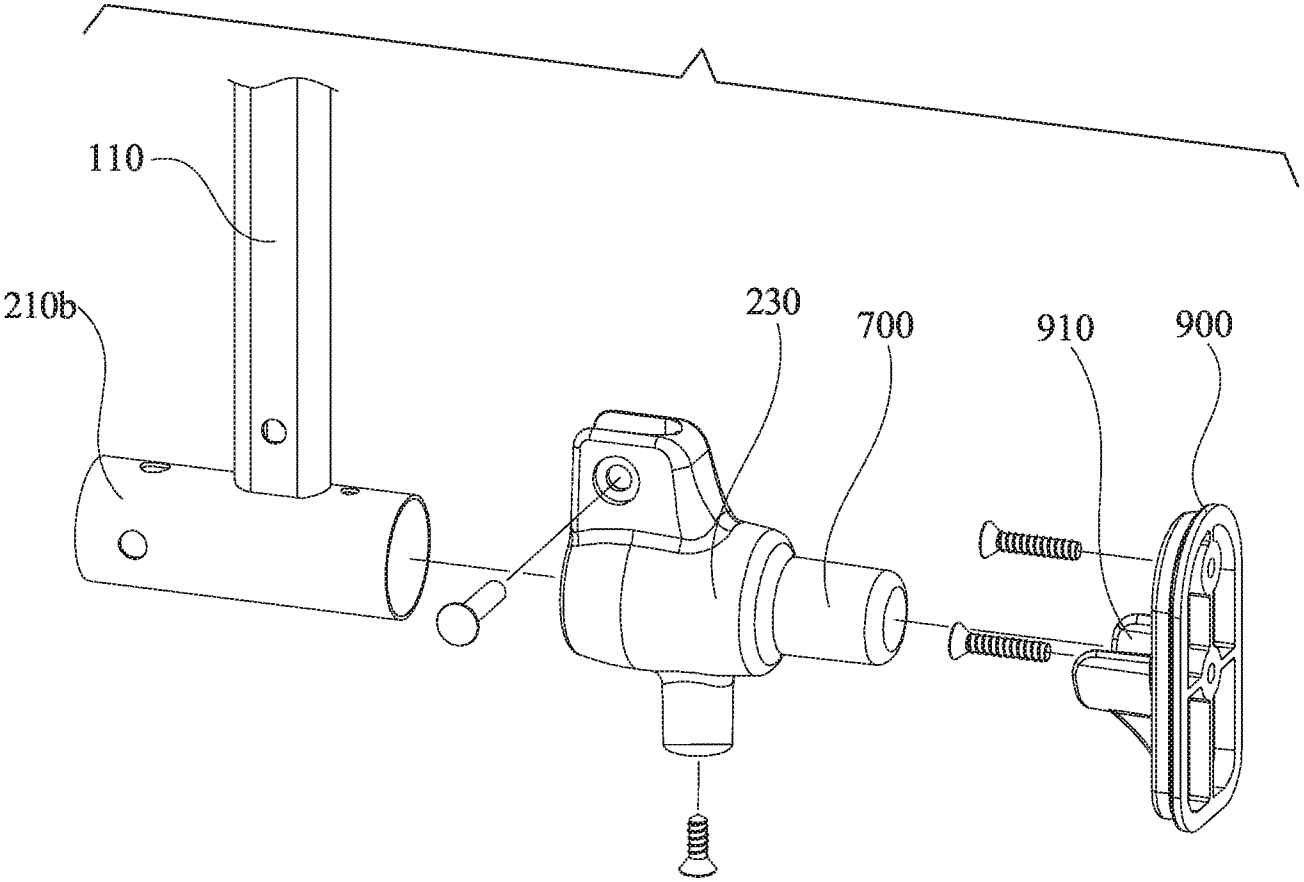
FIG. 11 is an enlarged exploded perspective view of the safety gate in FIG. 2.

With reference to FIGS. 1, 2, and 11, the locking element 600 and the mounting shaft 700 are respectively fixed to the two second connecting tubes 210*b*. The mounting shaft 700 is closer to ground than the locking element 600. The locking element 600 is fixed to the first overlap mechanism 800 which is mounted on one of the two columns. The mounting shaft 700 is fixed to the second overlap mechanism 900. The second overlap mechanism 900 has an overlap groove 910, and the overlap groove 910 is parallel to the first rod 110. The mounting shaft 700 is mounted in the overlap groove 910, and the mounting shaft 700 may be removed from the overlap groove 910 in a direction parallel to the first rod 110.

When the safety gate 10 is assembled, one side of the main body 100 is mounted on one of the two columns through the fixing component 400 and the adjustment element 500. The other side of the main body 100 is locked by the locking element 600, the mounting shaft 700, the first overlap mechanism 800 and the second overlap mechanism 900. When a user has to pass through the safety gate 10, the locking element 600 is opened and the main body 100 is pulled upward so that the ring portion 510 moves upward in the axial direction of the rotating shaft 430. At the same time, the mounting shaft 700 is pulled and removed from the overlap groove 910 shaft, and then the main body 100 is pivoted so that the ring portion 510 rotates around the rotation shaft 430 to open the safety gate 10.

Figure 12:
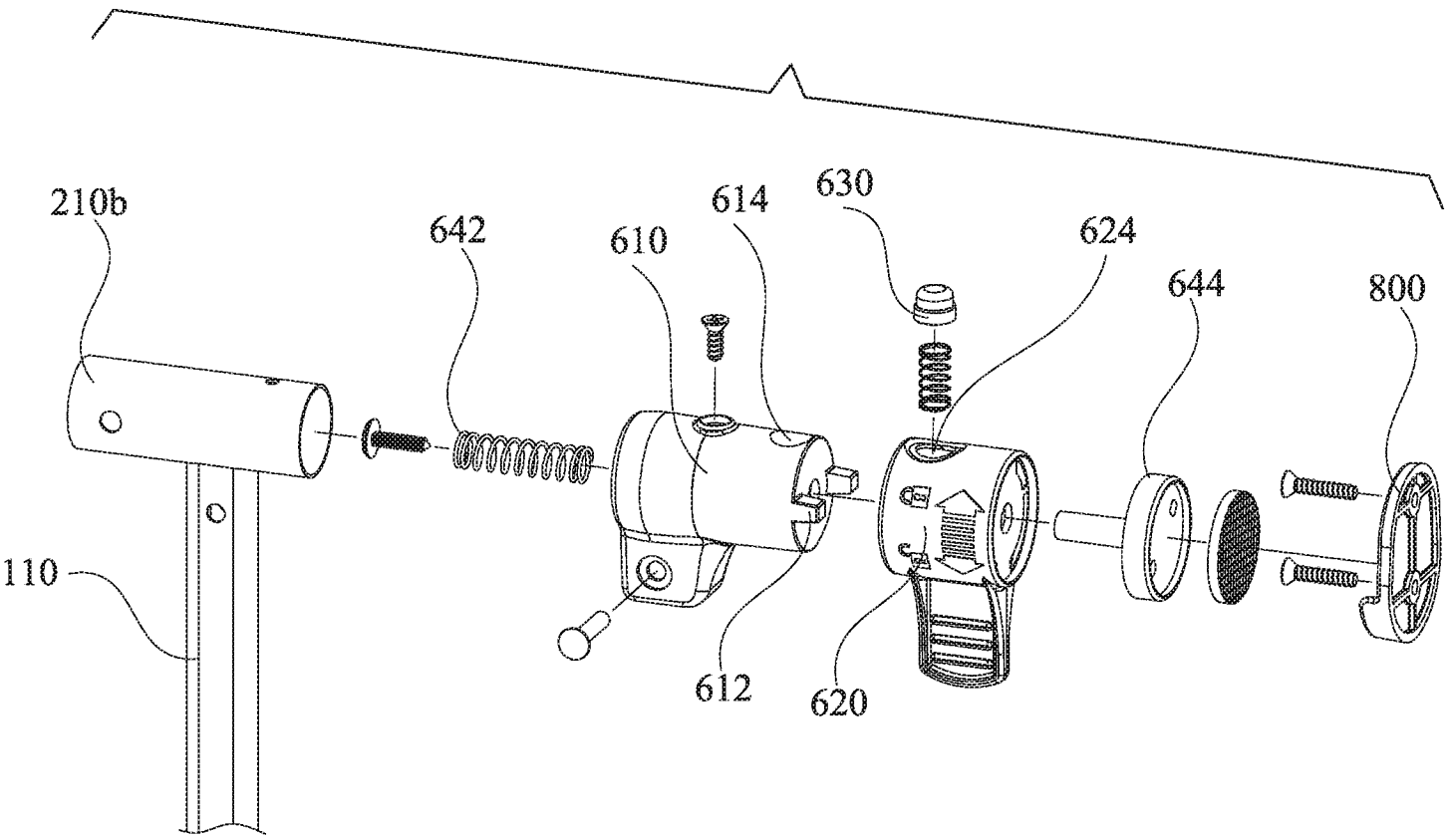
FIG. 12 is another enlarged exploded perspective view of the safety gate in FIG. 2.
Figure 13:
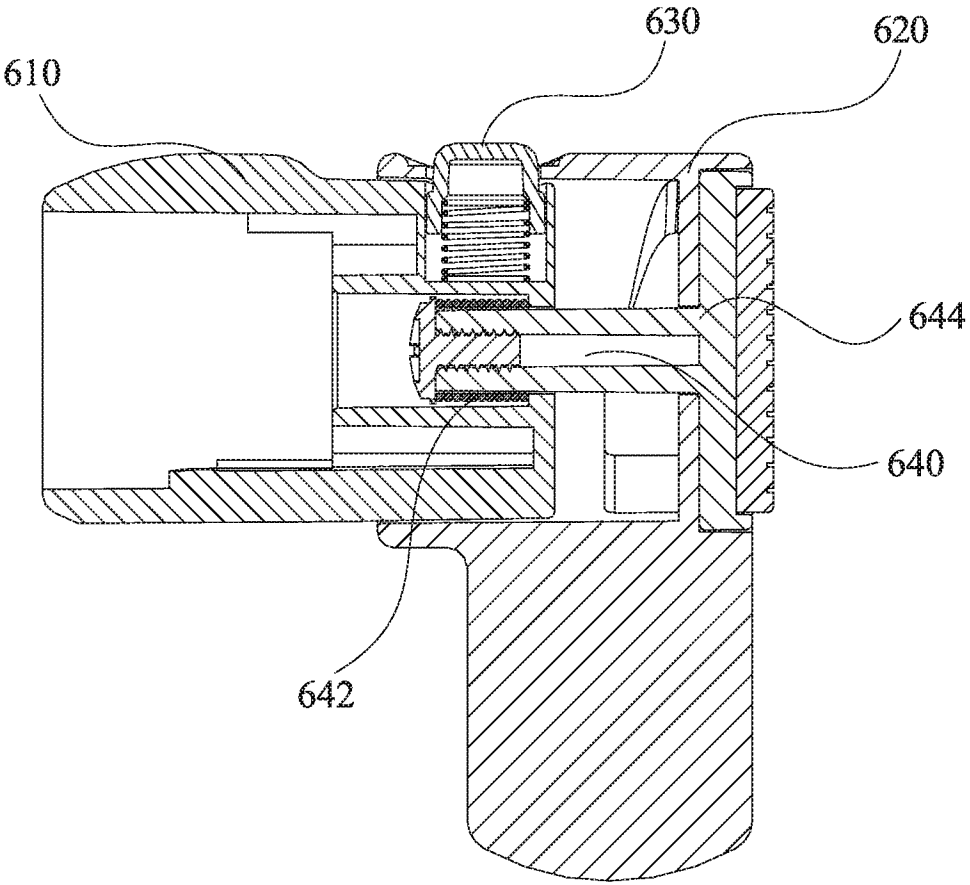
FIG. 13 is a cross sectional side view of a locking element of the safety gate in FIG. 1.
Figure 14:
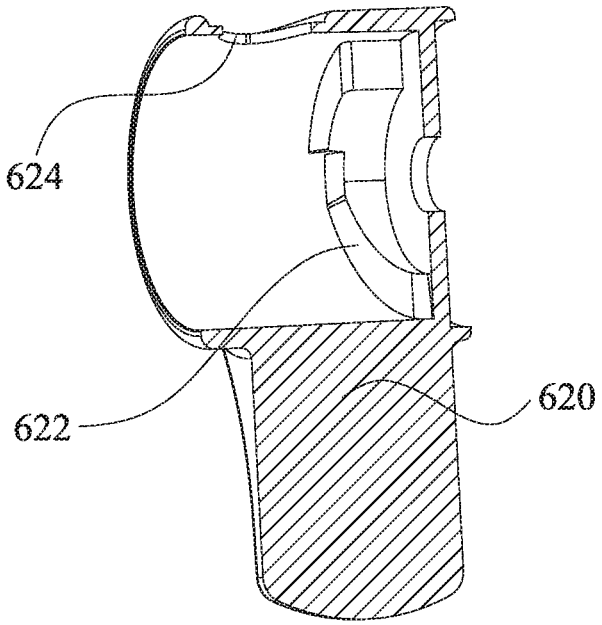
FIG. 14 is a perspective view in partial section of a moveable slider element of the safety gate in FIG. 1.

With reference to FIGS. 12, 13, and 14, the locking element 600 has a fixed slider element 610 and a moveable slider element 620. The fixed slider element 610 is cylindrical. The fixed slider element 610 is mounted around and fixed on the second connecting tube 210*b*. The fixed slider element 610 has a protruding block 612, and the protruding block 612 protrudes from a side end of the fixed slider element 610. The moveable slider element 620 is mounted around the fixed slider element 610. The moveable slider element 620 has an inner surface and a sliding protruding portion 622. The sliding protruding portion 622 protrudes from the inner surface of the moveable slider element 620 and is away from the fixed slider element 610. When the moveable slider element 620 is rotated, the protruding block 612 rotates along the sliding protruding portion 622 and the moveable slider element 620 abuts the first overlap mechanism 800. By providing the locking element 600 to adjust the distance between the second rod 120 and the first overlap mechanism 800, the end of the moveable slider element 620 away from the fixed slider element 610 can abut against the first overlap mechanism 800.

The locking element 600 further has a stopping element 630. The fixed slider element 610 has a positioning hole 614 formed in an outer surface of the fixed slider element 610. The stopping element 630 is mounted in the positioning hole 614 and abuts the inner surface of the moveable slider element 620. When the moveable slider element 620 is rotated, the protruding block 612 moves to an upper portion of the sliding protruding portion 622. The stopping element 630 is mounted through a circular hole 624 of the moveable slider element 620, and the moveable slider element 620 and the fixed slider element 610 are positioned. When the stopping element 630 is pressed, the moveable slider element 620 rotates in reverse, and the stopping element 630 abuts the inner surface of the moveable slider element 620. Accordingly, the protruding block 612 rotates along the sliding protruding portion 622, and the moveable slider element 620 detaches from one of the two columns, and the safety gate 10 can be opened.

Multiple sliding protruding portions 622 may be disposed on the inner surface of the moveable slider element 620, and multiple protruding blocks 612 may also be disposed on the fixed slider element 610 to ensure better structural stability. Specifically, two sliding protruding portions 622 are respectively disposed corresponding to the protruding blocks 612, and the sliding protruding portions 622 extend along the circumferential direction of the moveable slider element 620 by 90 degrees.

The locking element 600 further has a restoring set 640. The restoring set 640 has a restoring spring 642 and a restoring element 644. The restoring spring 642 is mounted in the fixed slider element 610. The restoring element 644 is T-shaped. The restoring element 644 is mounted through the moveable slider element 620 and the fixed slider element 610 along the axial direction of the second rod 120, and is connected to the restoring spring 642. Preferably, the restoring spring 642 is a compression spring.

When the protruding blocks 612 move along the sliding protruding portions 622 and push the moveable slider element 620 away from the second rod 120, the movable slider element 620 drives the restoring element 644 to move away from the second rod 120 and to move the restoring spring 642. The restoring spring 642 abuts against a top surface of the fixed slider element 610, and the restoring spring 642 applies a pulling force to the restoring element 644. When the stopping element 630 is pressed, the restoring element 644 can drive the movable slider element 620 to rotate in the opposite direction under the pulling force of the restoring spring 642. At this time, the restoring element 644 is separated from the column.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A safety gate comprising:

a main body having two first rods, each one of the first rods having a first end and a second end;

two second rods being perpendicular to the two first rods, each second rod having two end portions each having a connecting hole formed through the end portion;

four connecting tubes mounted respectively on the first and second ends of the two first rods and being perpendicular to the two first rods, and each connecting tube having a joining hole formed through the connecting tube, wherein each end portion of each second rod is mounted in a respective one of the connecting tubes, and the connecting hole faces the joining hole of a corresponding one of the connecting tubes; and two mounting holes formed through the connecting tube;

four inner tubes mounted respectively between the end portions of the two second rods and the four connecting tubes in interference fit and respectively mounted within the four connecting tubes, each one of the four inner tubes having two connecting walls disposed diametrically opposite each other and inserted in a corresponding one of the connecting tubes, and each one of the two connecting walls having a mounting stud protruding from an outer surface of the connecting wall and mounted through a respective one of the mounting holes of the corresponding connecting tube; and four first elastic pieces mounted respectively in the end portions of the two second rods, and each one of the four first elastic pieces having two first functional sides abutting an inner surface of a corresponding one of the end portions, and one of the first functional sides having a first protruding portion formed on a top surface of the first elastic piece and mounted through the connecting hole of a corresponding one of the second rods and the joining hole of a corresponding one of the connecting tubes.

2. The safety gate as claimed in claim 1, wherein each inner tube has two escaping walls abutting the two first functional sides of a corresponding one of the first elastic pieces respectively; and two escaping recesses formed respectively in the escaping walls and being adjacent to one of the first rods; and two receiving recesses formed respectively in bottoms of the escaping recesses and each having a shape corresponding to a shape of the first protruding portion of the corresponding first elastic piece; and the first protruding portion of each first elastic piece is mounted in one of the two receiving recesses and is mounted through one of the escaping recesses of a corresponding one of the inner tubes.

3. The safety gate as claimed in claim 2, wherein each inner tube has a ring body connected with the two escaping walls and the two connecting walls.

4. The safety gate as claimed in claim 1, wherein the safety gate has two third rods, each third rod is parallel to the two first rods, and an end of each third rod is inserted into one of the second rods.

5. The safety gate as claimed in claim 1, wherein each one of the second rods has an outer tube having multiple outer through holes formed through the outer tube and aligned in a row;

an inner tube mounted in the outer tube and having multiple inner through holes formed through the inner tube; and a second elastic piece mounted in the inner tube and having two second functional sides abutting an inner surface of the inner tube; and a second protruding portion protruding from one of the second functional sides and mounted through one of the outer through holes and one of the inner through holes; and at least one of the end portions of each second rod is arranged at the inner tube of the second rod.

6. The safety gate as claimed in claim 5, wherein the end portions of each second rod include a first end section formed at one end of the second rod; and a second end section formed at the other end of the second rod, and being a part of the inner tube of the second rod.

7. The safety gate as claimed in claim 6, wherein the four connecting tubes include two first connecting tubes and two second connecting tubes, the first connecting tubes are connected respectively with the first end section of the second rods, and the second connecting tubes are connected respectively with the second end section of the second rods.

8. The safety gate as claimed in claim 4, wherein the safety gate has a cloth cover having four notches;

a first insertion hole;

a second insertion hole; and a third insertion hole;

one of the two first rods is mounted through the first insertion hole, and two ends of the first rod extend from two of the four notches;

one of the two second rods is mounted through the second insertion hole, and two ends of the second rod extend from two of the four notches; and one of the two third rods is mounted through the third insertion hole, and two ends of the third rod extend from two of the four notches.

9. The safety gate as claimed in claim 1, wherein the first rods are square tubes, and the connecting tubes and the end portions of the second rods are circular tubes;

the safety gate further has four sockets, each socket having a cylindrical body having a first end, a second end, and a mounting groove, the mounting groove formed in the first end of the cylindrical body; and two clamping boards mounted on the first end of the cylindrical body;

each connecting tube is inserted into the cylindrical body of a respective one of the sockets; and each end of the two first rods is mounted between the two clamping boards of one of the sockets.

* * * * *